US005226566A

United States Patent [19]

Brandenburg

[11] Patent Number: 5,226,566

[45] Date of Patent: Jul. 13, 1993

[54] MODULAR COUNTER MOUNTED FLUID DISPENSING APPARATUS

[75] Inventor: Allen E. Brandenburg, Austin, Tex.

[73] Assignee: Scott Paper Company, Philadelphia, Pa.

[21] Appl. No.: 899,954

[22] Filed: Jun. 17, 1992

Related U.S. Application Data

[63] Continuation of Ser. No. 578,073, Sep. 5, 1990, abandoned.

[51] Int. Cl.[5] ..... B67D 5/00

[52] U.S. Cl. ..... 222/180; 222/325; 222/377; 222/382; 222/385

[58] Field of Search ..... 222/105, 180, 192, 325, 222/372, 377, 382, 385; 239/331, 333

[56] References Cited

U.S. PATENT DOCUMENTS

| | | | |
|---|---|---|---|
| 921,594 | 5/1909 | Grane | 222/385 |
| 1,789,338 | 1/1931 | Kooperstein | 222/385 |
| 1,838,735 | 12/1931 | Berg | 222/385 |
| 1,886,022 | 11/1932 | Hutton | 222/385 |
| 1,892,196 | 12/1932 | Thompson | 222/385 |
| 1,951,910 | 3/1934 | Heffner et al. | 222/385 |
| 2,022,208 | 11/1935 | Lacke | 222/385 |
| 2,183,370 | 12/1939 | Selitzky | 222/385 |
| 2,204,838 | 6/1940 | Walstrom | 222/385 |
| 2,205,875 | 6/1940 | Coffey et al. | 222/385 |
| 2,540,890 | 2/1951 | Kestenbaum | 222/385 |
| 3,562,111 | 7/1951 | Michel | 222/325 |
| 2,603,389 | 7/1952 | Maxwell | 222/385 |
| 2,639,063 | 5/1953 | Yuza | 222/385 |
| 2,657,833 | 11/1953 | Steczynski et al. | 222/385 |
| 2,837,246 | 6/1958 | Steele | 222/385 |
| 2,869,762 | 1/1959 | Sanders | 222/385 |
| 3,018,489 | 1/1962 | Saflarski | 222/385 X |
| 3,144,177 | 8/1964 | Cookson | 222/385 X |
| 3,420,413 | 1/1969 | Corsette | 222/385 |
| 3,730,398 | 5/1973 | Goda | 222/385 X |
| 4,625,896 | 12/1986 | Rocchelli | 222/372 X |
| 4,869,404 | 9/1989 | Elliott | 222/385 |
| 4,938,384 | 7/1990 | Pilolla et al. | 222/566 X |

FOREIGN PATENT DOCUMENTS

| | | | |
|---|---|---|---|
| 544551 | 6/1922 | France | 222/385 |
| 551104 | 12/1922 | France | 222/385 |
| 772485 | 8/1934 | France | 222/385 |

*Primary Examiner*—Andres Kashnikow
*Assistant Examiner*—Anthoula Pomrening
*Attorney, Agent, or Firm*—Mark B. Bocchetti; John W. Kane, Jr.

[57] ABSTRACT

A substantially modularized countertop mounted liquid soap dispensing system, including a delivery module comprised of a housing, a frame, a delivery spout and an actuator channel through this frame. Residing in the actuator channel is an actuator rod assembly. The lower portion of the actuator rod assembly is free. Attached to the lower portion of the frame is a canister top adapted to engage a canister for enclosing a disposable liquid soap reservoir module. The liquid soap reservoir module is substantially completely enclosed such that the liquid soap within is not exposed to the atmosphere until it is pumped from the module. The disposable reservoir module includes an enclosing top section, a lower cap and a pump affixed to the lower cap. There is a guide cylinder extending from the enclosing top section to the pump for receipt of the free end of the piston rod assembly. A flexible tube extends from the pump and is easily inserted into and withdrawn from the delivery spout.

22 Claims, 5 Drawing Sheets

MODULAR COUNTER MOUNTED FLUID DISPENSING APPARATUS

This application is a continuation application of application Ser. No. 07/578,073 filed Sep. 5, 1990, now abandoned.

BACKGROUND OF THE INVENTION

1. Field of the Invention

This invention relates generally to fluid dispensing apparatus and more particularly to countertop mounted liquid soap dispensers.

2. Brief Description of the Prior Art

There are a variety of countertop mounted fluid dispensers known in the prior art. These dispensers have typically included refillable soap reservoirs into which dip tubes are inserted. The dip tubes have typically included one or two check valves and a piston-type pump. These pump and valve arrangements have always been permanent installations and over a period of time the valves and/or pumps often fail or become clogged such that no soap can be dispensed.

One such dispenser is depicted in U.S. Pat. No. 1,229,556 to Watrous. Watrous teaches a dip tube extending downward into a reservoir wherein the dip tube has a ball check valve at the base thereof. In order to refill the reservoir, it is necessary to disengage the reservoir from mounting bracket and pour liquid soap into the open topped receptacle.

Another soap dispenser is shown in U.S. Pat. No. 923,447 to Schmidt which teaches a relatively typical piston driven pump arrangement. The piston rod and the piston are contiguous and intended to be a permanent installation. In order to fill the receptacle of Schmidt, it is necessary to remove the pumping apparatus from the countertop and then remove the receptacle from below the countertop. Liquid soap can then be poured into the container and the entire assembly is reinstalled.

Nothing in the prior art teaches a bifurcated modular system wherein there is a permanent actuator rod dispenser assembly which engages with a disposable reservoir and piston pump module. Nothing in the prior art teaches a soap reservoir the internals of which are substantially sealed from atmospheric contamination at all times. The prior art further fails to teach a system or apparatus in which the permanent dispensing spout does not act as the primary conduit for the delivery of liquid soap.

SUMMARY OF THE INVENTION

It is therefore an object of the present invention to provide the countertop mounted liquid soap dispensing apparatus which includes a permanently mounted actuator rod and dispenser spout module adapted to be used in conjunction with the disposal soap reservoir and piston pump module.

It is another object of the present invention to provide a liquid soap reservoir, the internal soap which remains substantially sealed from the environment at all times.

Another object of the present invention is to provide a soap dispensing apparatus where the actuator rod channel and actuator rod do not come in contact with the soap.

A further object of the present invention is to provide a soap dispensing apparatus where liquid soap does not come in contact with the internal service of the dispenser spout.

Still another object of the present invention is to provide a disposable soap reservoir cartridge containing its own positive displacement pump and delivery tube.

It is another object of the present invention to provide a positive displacement pump for dispensing liquid soap where the pump piston serves simultaneously as both the pump piston and a check valve.

Still a further object of the present invention is to provide a countertop mounted soap dispensing where the actuator is angled from the vertical toward the user in a more ergonomic position.

Yet another object of the present invention is to provide a liquid soap dispensing system wherein soap cannot be spilled from the reservoir during loading or unloading.

Briefly stated, the foregoing and numerous other objects, features and advantages of the present invention will become readily apparent upon reading of the detailed description, claims and drawings set forth herein. These objects, features and advantages are accomplished through the creation of a disposable reservoir module for liquid soap having incorporated therein a positive displacement pump at the base thereof. This disposable reservoir module includes a guide cylinder for receiving an actuator rod for actuating the positive displacement pump. The guide cylinder internals are sealed from the pump and the soap reservoir bag such that the liquid soap is not exposed thereto.

The disposable reservoir module is used in conjunction with a countertop mounted dispensing module. The dispensing module includes a delivery spout and the manually operated actuator rod assembly mentioned above which actuates the positive displacement pump in the disposable reservoir module.

A flexible delivery tube is further provided to the disposable reservoir module for insertion through the delivery spout of the countertop mounted dispenser module. Once the disposable reservoir module is in place, it is supported within a bayonet mounted support canister.

DETAILED DESCRIPTION OF THE PREFERRED EMBODIMENT

Figure 1:
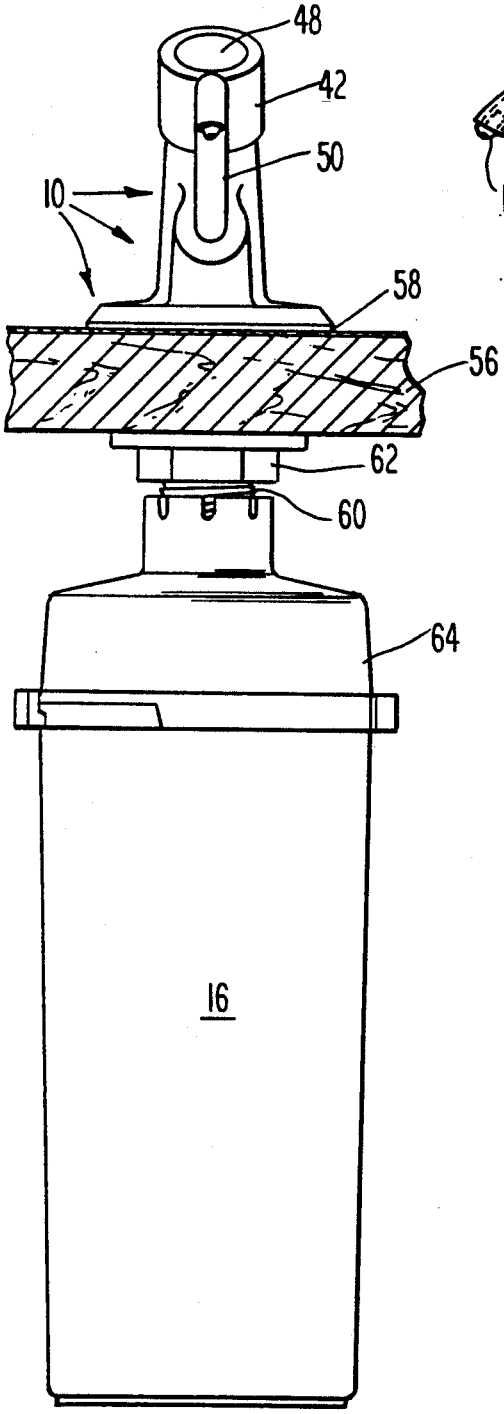
FIG. 1 is front elevation of the liquid soap dispensing apparatus of the present invention.
Figure 2:
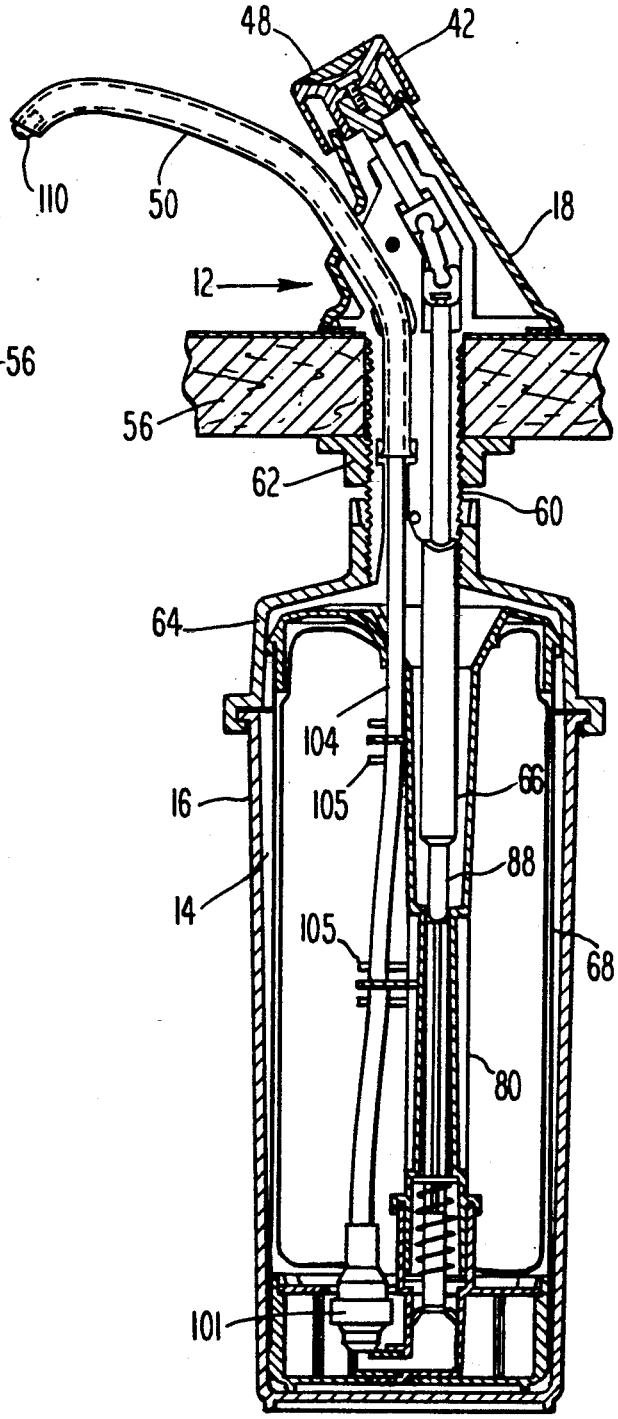
FIG. 2 is cross sectional view of the liquid soap dispensing apparatus of the present invention taken along line 2—2 of FIG. 1.
Figure 3:
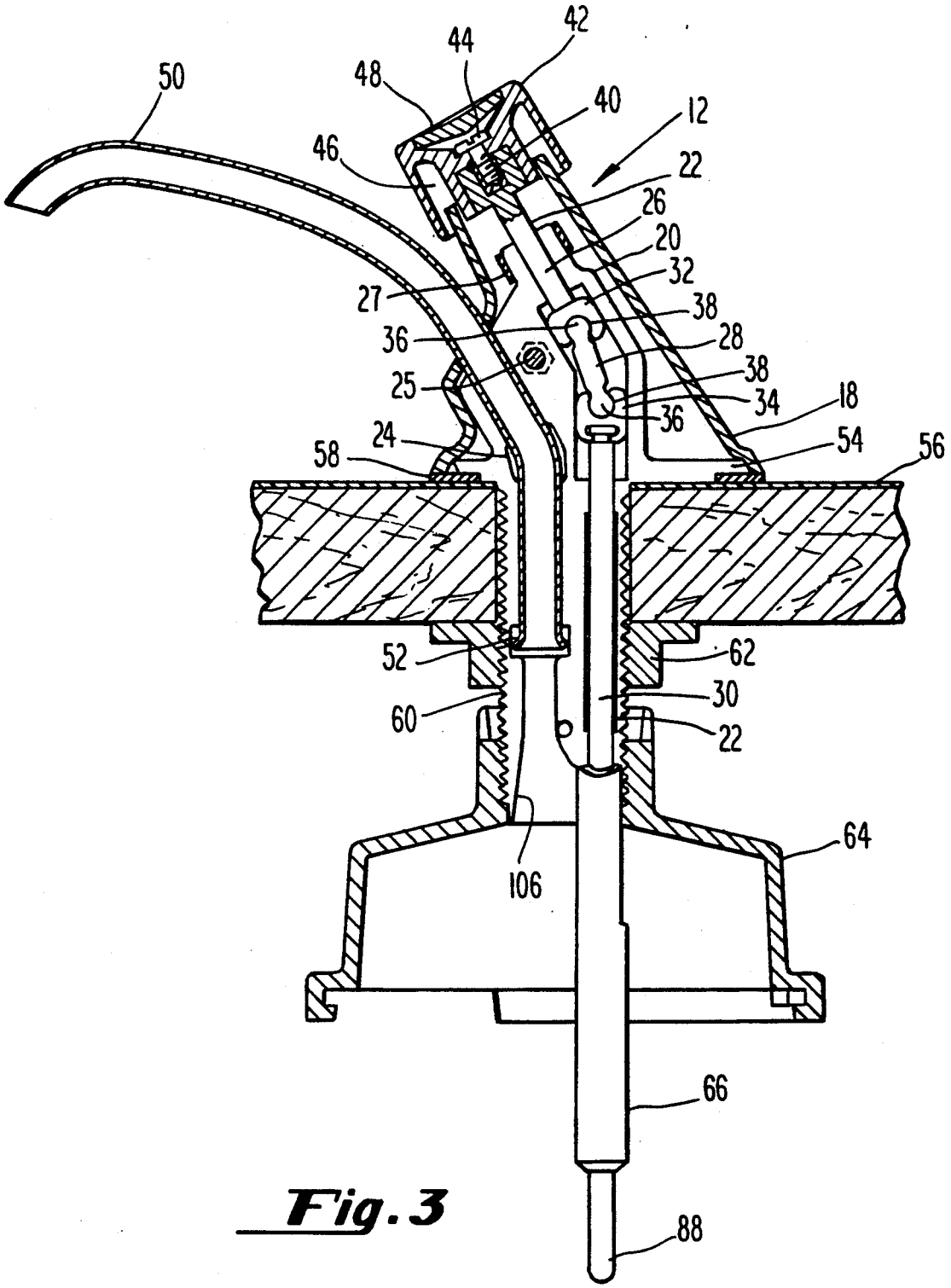
FIG. 3 is an enlarged cross sectional view of the dispensing module of the present invention.

Turning first to FIG. 1 there is shown the liquid soap dispensing apparatus 10 of the present invention. The liquid soap dispensing apparatus 10 includes a delivery spout module 12 and a reservoir and pump module 14. Reservoir and pump module 14 is supported within canister 16. Delivery spout module 12 includes a housing 18 which contains frame 20.(See FIG. 2 and FIG. 3) Frame 20 is actually made up of two adjacent pieces forming there between actuator rod channel 22 and delivery spout bore 24. The two pieces of frame 20 are held together by screw and hex nut 25 as well as by annular brass sleeve 27 and ultrasonic welding. Both actuator rod channel 22 and delivery spout bore 24 are angulated and the angulation of each is similarly obtuse, preferably 60° from the horizontal.

Contained within actuator rod channel 22 are upper actuator rod 26, link 28 and lower actuator rod 30 forming an actuator rod assembly. The lower portion of upper actuator rod 26 terminates in a boxed end female connector 32. Similarly, the upper end of the lower actuator rod 30 terminates in a boxed end female connector 34. Disposed between female connectors 32 and 34 is link 28. Link 28 includes two substantially cylindrical ends 36, the cylindrical axes of which are substantially perpendicular to the cylindrical axes of actuator rod channel 22. Cylindrical ends 36 reside engagingly in the substantially cylindrical channels 38 of female connectors 32 and 34 in such manner that, as upper actuator rod 26 is driven downward in actuator rod channel 22, female connectors 32 and 34 and link 28 allow for a pivoting movement through the angulated portion of actuator rod channel 22 thereby driving lower actuator rod 30 simultaneously downward within actuator rod channel 22.

The upper portion of upper actuator rod 26 terminates in a threaded receptacle 40. There is a cap 42 attached to threaded receptacle 40 by means of screw 44. Cap 42 has an annular channel 46 for slidable engagement with the upper portion of housing 18. Cap 42 is provided with a snap-in button 48 covering the top of screw 44.

Disposed within delivery spout bore 24 is delivery spout 50. Delivery spout 50 includes outwardly flared end 52. Delivery spout 50, is preferably made of stainless steel. Housing 18 is preferably chrome plated acrylonitrile butadiene styrene (ABS).

Extending radially outwardly from frame 20 is support flange 54 which is adapted to reside in abutting position with a countertop 56. A resilient washer 58 is provided to allow for substantially sealed engagement between housing 18, support flange 54 and countertop 56 thereby preventing the intrusion of water and soap which may collect on countertop 56 into housing 18.

The lower portion of frame 20 includes threaded nipple 60. Threadably engaging nipple 60 is nut 62. Nut 62 engages the lower surface of countertop 56 thereby holding the frame 20 and housing 18 securely to countertop 56.

Also threadably engaging nipple 60 is canister top 64. Extending down from nipple 60 through canister top 64 is actuator rod sleeve 66. Actuator rod sleeve 66 is substantially coaxial with lower actuator rod 30 and lower actuator rod 30 extends through and beyond actuator rod sleeve 66. Canister top 64 is adapted for bayonet type mounting to canister 16. Disposed within canister 16 and canister top 64 is reservoir and pump module 14. Reservoir and pump module 14 includes a substantially cylindrical container section or wall 68. Mounted to the top of container section 68 is enclosing top section 70. Top section 70 has an opening 71 therein. Angling downward and inward of opening 71 are a plurality of fingers 73. There is a guide cylinder 80 extending down through said top section 70. Guide cylinder 80 includes a funnel-like opening 72 which has an annular ridge 75 on the outside thereof. The ends of fingers 73 engage ridge 75 when guide cylinder 80 is fully inserted into top section 70. There is a delivery tube slot 74 into funnel-like opening 72. An arcuate, free-end finger 77 extending from top section 70 aligns with delivery tube slot 74.

Mounted to the base of wall 68 is lower cap 76 which is substantially cylindrical. Mounted within lower cap 76 and extending upward therefrom is pump housing 78. Extending radially outward from pump housing 78 is wall 81 which circumferentially engages annular lip 83 extending radially inward from lower cap 76. Pump housing 78 is press fit into and ultrasonically welded to guide cylinder 80 at annular channel 85.

Figure 12:
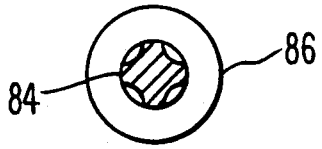
FIG. 12 is a cross sectional view of the pump shaft taken along line 12—12 of FIG. 11.

Contained within reservoir and pump module 14 is a collapsible bag 82 of liquid soap which includes a bag outlet nozzle ultrasonically welded thereto. The bag outlet nozzle is press fit onto pump suction nozzle 98. Bag 82 wraps around guide cylinder 80 inside of container wall 68. Residing within guide cylinder 80 is pump shaft 84 more clearly depicted in FIG. 4. The top of pump shaft 84 resides in abutting position with the distal end 88 of the lower actuator rod 30. The lower end of pump shaft 84 connects to pump piston 90 which extends into pump housing 78. The cross section of pump shaft 84 is a cross as shown clearly in FIG. 12. There is a flange 86 radially extending from pump shaft 84. An annular, resilient seal 92 is provided about pump piston 90 providing a seal between pump piston 90 and pump housing 78. There is a washer 93 resting on seal 92. Spring 94 resides between flange 86 and washer 93.

Pump piston 90 includes two hinged wing sections or members 96 extending therefrom. Pump piston 90 and hinged members 96 are preferably molded polypropylene. The narrowness of the joindor of wing members 96 to the main body of pump piston 90 creates what is often referred to as a "living" hinge. Hinged wing members 96 extend outwardly in sealing engagement with the internal walls of pump housing 78 on the downward pumping stroke of pump piston 90. As pump piston 90 moves upwardly in housing 78 in an intake or nonpumping stroke, the weight and the viscosity of liquid soap within pump housing 78 above hinged sections 96 causes hinged sections 96 to pivot inwardly and away from the internal walls of pump housing 78 thereby allowing liquid soap to pass around and below pump piston 90 in preparation for the next downward pumping stroke. In such manner, pump piston 90 with hinged sections 96 function as both a positive displacement piston and a check valve. The preferable range of liquid soap viscosities for which the pump piston 90 and hinged sections 96 will adequately perform is 50 to 15,000 cps.

Extending from pump housing 78 is pump suction nozzle 98 which is bayonet mounted and ultrasonically welded to pump housing 78 and extends through an opening in wall 81. Pump housing 78 is provided with discharge nozzle 100. Ultrasonically welded to discharge nozzle 100 is ball check valve 101 which includes spring 102 and ball 103. Depending on soap viscosity ball check valve 101 can be replaced with a duck bill check valve. Ball check valve 101 prevents soap from backflowing into pump housing 78 and therefore aids in promoting the downward movement of hinged sections 96 during an intake or non-pumping stroke. In operation, ball 103 unseats with each pumping stroke of pump piston 90 allowing soap to flow through ball check valve 101. On the non-pumping or suction stroke of piston 90, spring 102 drives ball 103 downward to reseat within check valve 101. As ball 103 moves to reseat it pulls or sucks back a small quantity of soap contained in delivery tube 104. In such manner, dripping and stringing of soap from distal end 110 is prevented. Extending from check valve 101 is flexible delivery tube 104. Delivery tube 104 is supported along the outside of guide cylinder 80 by brackets 105 and extends through delivery tube slot 74. Arcuate, free-end finger 77 provides non-crimping support for delivery tube 104 in slot 74.

Figure 4:
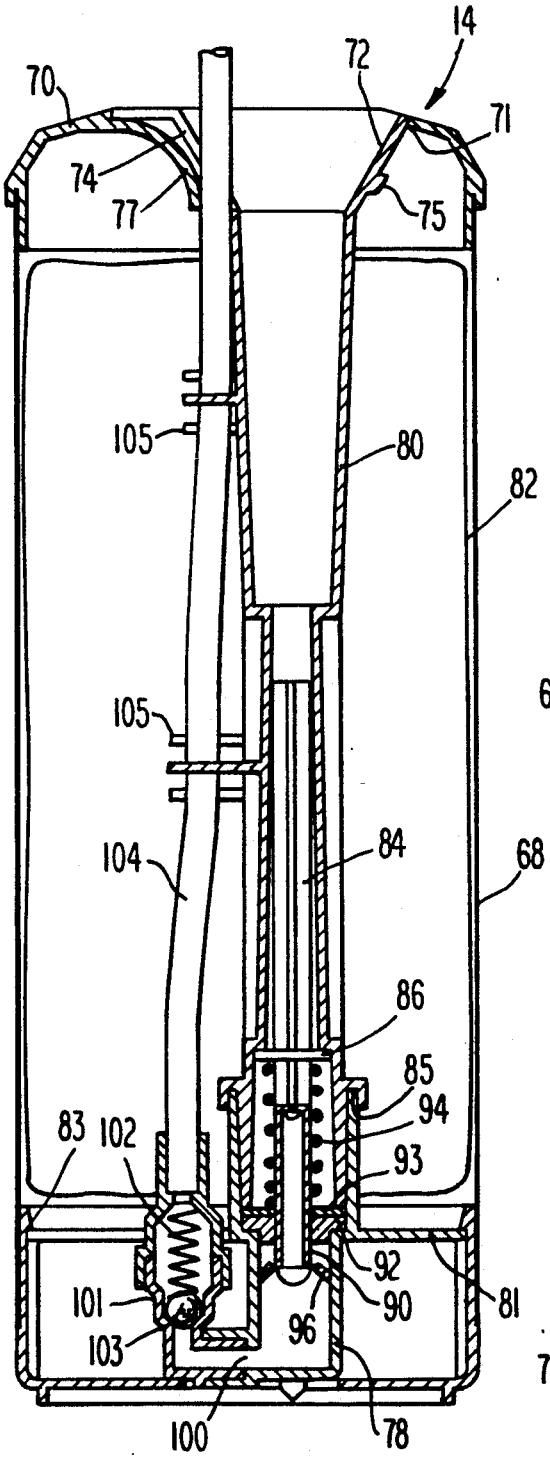
FIG. 4 is an enlarged cross sectional view of the reservoir module of the present invention.

It should be noted that FIG. 4 shows pump housing 78 to be eccentricly mounted within reservoir and pump module 14. Although FIG. 4 shows check valve 101 to extend from pump housing 78 to the wide side of the eccentricity, it may be more advantageous to have suction nozzle 98 extend to the wide of the eccentricity. In such manner, more room will be provided to attach the outlet nozzle of collapsible bag 82 to suction nozzle 98 allowing for easier assembly.

Figure 13:
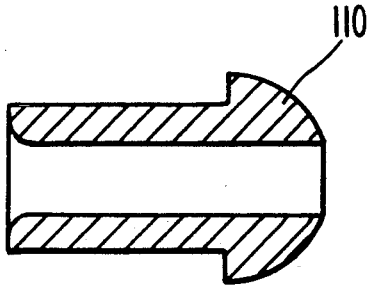
FIG. 13 is a cross sectional view of the distal end of the delivery tube.

Delivery spout module 12 is intended to be permanently mounted to a countertop 56 as previously described. In order to install a reservoir and pump module 14 to thereby provide an adequate supply of liquid soap to the dispensing apparatus 10 of the present invention, support canister 16 is disconnected from canister top 64. Reservoir and pump module 14 may then be placed in support canister 16 and positioned such that as support canister 16 is raised to reconnect to canister top 64, delivery tube 104 inserts into funnelled aperture 106 and through delivery spout 50. Similarly, the distal end 88 of lower actuator rod 30 inserts through funnel-like opening 72 and into guide cylinder 80. As support canister 16 is mated with canister top 64, the distal end 88 of piston rod 30 resides in abutting position with shaft 84. Flared end 52 prevents delivery tube 104 from getting caught on bottom edge of spout 50 during insertion. Further, the distal end 110 of delivery tube 104 is substantially hemispherical with a center bore through which soap can pass. (See FIG. 13.) The hemispherical shape of distal end 110 also aids in the easy insertion of delivery tube 104 into spout 50.

In operation, the user need only press cap 42 downward on housing 18 thereby causing actuator rod 30 to drive pump shaft 84 and pump piston 90 downward thereby pumping liquid soap from pump housing 78 through ball check valve 101 and delivery tube 104 for receipt by the user. As the user releases button 48, spring 94 drives pump shaft 84 upward within cylinder 80 causing pump piston 90 to move upward within pump housing 78 in readiness for the next pumping stroke. Because piston rod channel 22 is obtusely angulated, cap 42 and upper piston rod 26 are angled toward the user in a more ergonomic position than a typical vertically arranged piston rod.

Delivery tube 104 extends completely through the length of delivery spout 50 such that the distal end 110 resides beyond the end of spout 50 thus ensuring that no soap contacts the inner wall of spout 50 where contamination and/or bacterial infestations could occur over periods of time.

Figure 5:
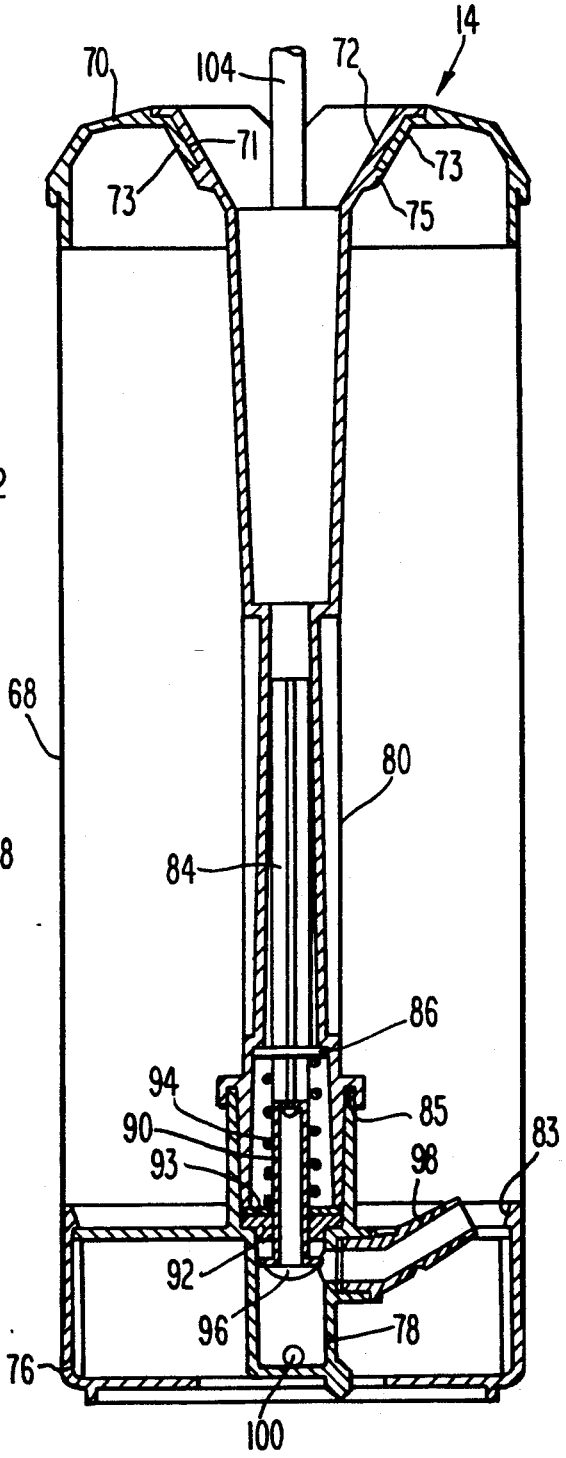
FIG. 5 is an enlarged cross sectional view of the dispensing module of the present invention rotated 90° from the view depicted in FIG. 4.
Figure 7:
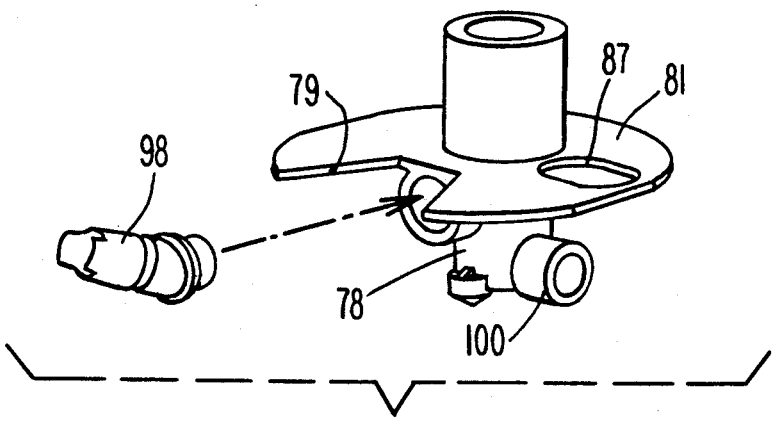
FIG. 7 is an isometric view of the pump housing with the suction nozzle exploded therefrom.
Figure 6:
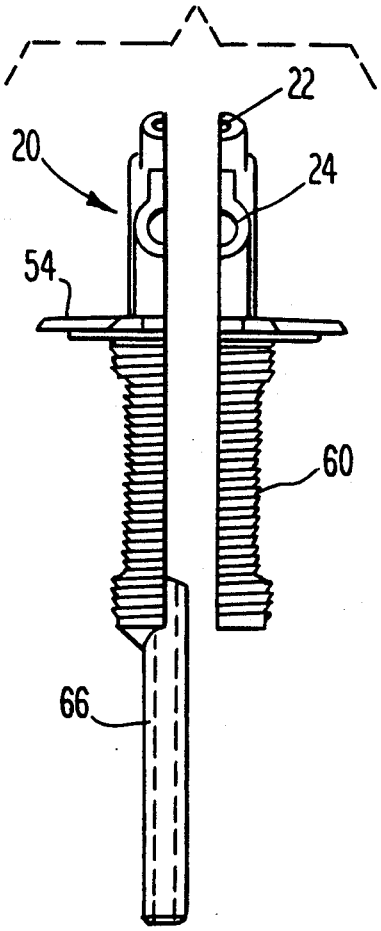
FIG. 6 is an exploded front elevation of the frame.
Figure 8:
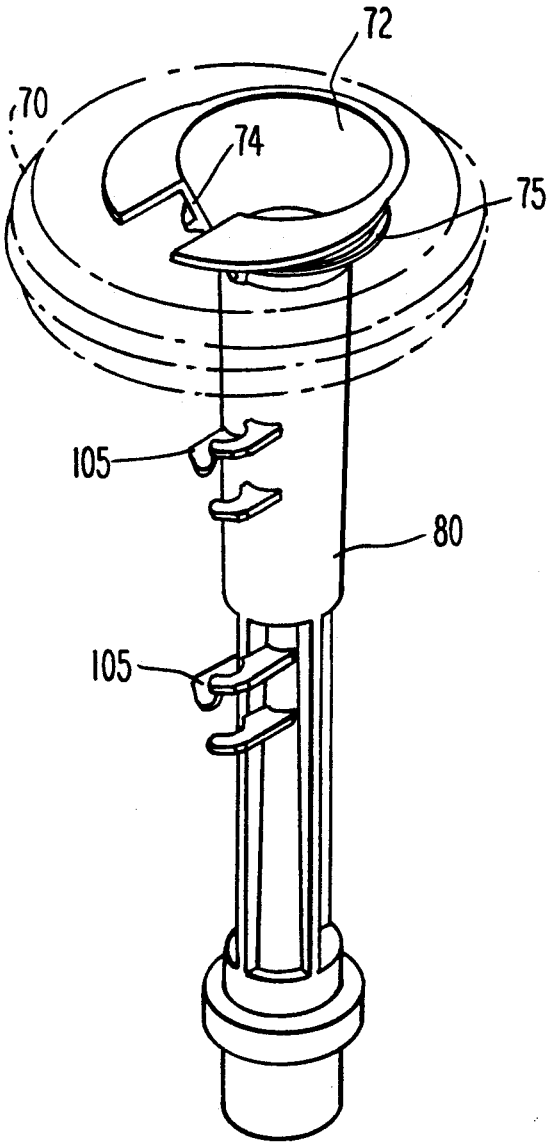
FIG. 8 is an isometric view of the guide cylinder and funnel-like opening with the top section shown in ghost.
Figure 9:
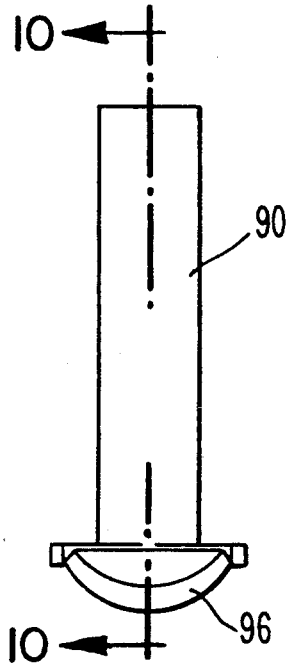
FIG. 9 is a side elevation of the pump piston.
Figure 10:
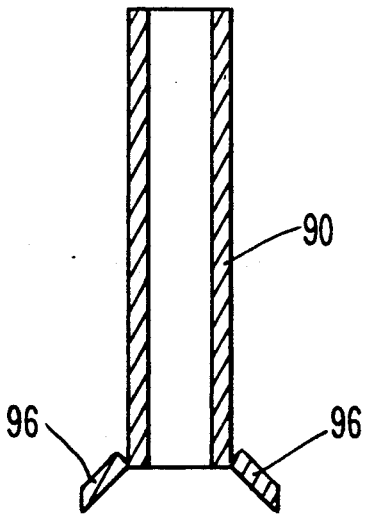
FIG. 10 is a cross section of the pump piston taken along line 10—10 in FIG. 9.
Figure 11:
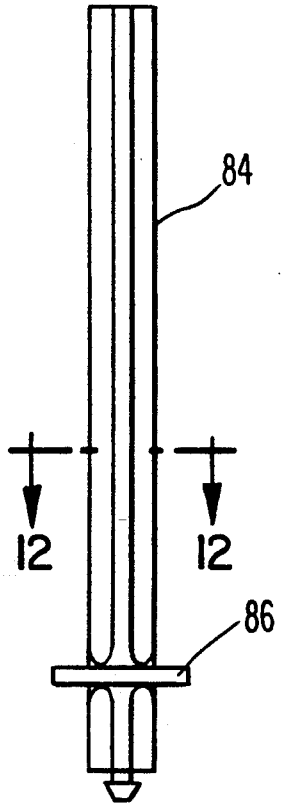
FIG. 11 is a side elevation of the pump shaft.

Projecting from the base of pump housing 78 is pivot point 112. Although not shown as such in FIGS. 4 and 5, pivot point 112 is located on the cylindrical axis of refill or reservoir module 14. Pivot point 112 descends to a substantially conical end which is intended to reside in and be supported by a hub in the bottom of support canister 16. Such hub includes a mating conical recess. Refill module 14 is thus vertically supported upon pivot point 112 when installed within support canister 16. Refill module 14 and support canister may therefore rotate relative to one another, allowing the bayonet mounting of support canister 16 to canister top 64 without the possibility of twisting or kinking delivery tube 104.

It should be recognized that because reservoir module is disposable, each time a reservoir module 14 is spent of liquid soap, it is replaced with a new module 14. A new reservoir module 14 necessarily includes a new pump piston 90 and a new ball check valve. This modular replacement feature of the present invention therefore obviates the problems of valve and pump wear failure faced in the prior art.

Although the figures show pump housing 78 mounted within lower cap 76, pump housing 78 may be affixed to guide tube 80 near upper cap 70. In such an arrangement, a suction tube extending from suction nozzle 98 to the bottom of collapsible bag 82 would be required.

It should be understood that if the connection of container section 68 to lower cap 76 and upper cap 70 is made liquid tight, collapsible bag 82 may be eliminated. This would necessitate the inclusion of a vent through upper cap 70 to allow air to flow into refill 14 as soap is pumped therefrom.

From the foregoing, it will seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A countertop mounted soap dispensing apparatus for use with a liquid soap reservoir module, said dispensing apparatus comprising:

a) a frame including a nipple extending through the countertop;

b) an actuator rod extending through said frame and nipple;

c) a sleeve about said actuator rod extending downward from said nipple, said actuator rod extending beyond said sleeve and having a free distal end unaffixed to a pump piston for abutting a spring biased piston pump assembly when said free distal end is inserted into the liquid soap reservoir module.

2. A countertop mounted soap dispensing apparatus as recited in claim 1 further comprising:

a delivery spout extending through said frame, said delivery spout having proximal and distal ends, said distal end being flared.

3. A countertop mounted soap dispensing apparatus as recited in claim 2 further comprising:

a) a bore in said frame for receiving said delivery spout;

b) a funnelled aperture in said nipple substantially aligning with said bore.

4. A countertop mounted soap dispensing apparatus as recited in claim 1 further comprising:

a) a canister top mounted on said nipple;

b) a canister engageable with said canister top.

5. A countertop mounted soap dispensing apparatus as recited in claim 4 further comprising:

a disposable liquid soap reservoir module including a pump adapted to reside in said canister.

6. A countertop mounted soap dispensing apparatus as recited in claim 5 wherein said liquid soap reservoir module is further comprised of:

a) a container section including an enclosing top and a bottom cap;

b) a cylinder extending from said enclosing top through said container section to said pump.

7. A countertop mounted soap dispensing apparatus as recited in claim 1 further comprising:

attachment means engageable with said nipple for holding said frame on the countertop.

8. A countertop mounted soap dispensing apparatus as recited in claim 1 further comprising:

a flange extending substantially radially from said frame for abutment with the countertop.

9. A countertop mounted soap dispensing apparatus as recited in claim 1 further comprising:

a liquid soap reservoir module, said liquid soap reservoir module comprising;

(a) a container section having an enclosing top section affixed thereto;

(b) a pump housing affixed to said container section;

(c) a cylinder extending from said pump housing to said top section, said cylinder adapted to receive said actuator rod;

(d) a spring biased piston within said pump housing; and (e) a pump shaft affixed at one end to said piston and having a free end extending into said cylinder to operatively engage said actuator rod.

10. A countertop mounted soap dispensing apparatus as recited in claim 1 wherein:

said actuator rod is articulated.

11. A liquid soap reservoir module for use with a liquid soap dispensing apparatus, the liquid soap dispensing apparatus including a support canister, a delivery spout and an actuator rod with a free distal end, said liquid soap reservoir module comprising:

a) a container section including an enclosing top and a bottom cap;

b) a pump affixed to said container section;

c) a cylinder extending from said enclosing top into said container section to said pump;

d) a pump drive shaft extending from said pump into said cylinder, said pump drive shaft abutting the free distal end of the actuator rod when said liquid soap reservoir module is mounted within said support canister.

12. A liquid soap reservoir module as recited in claim 11 further comprising:

a flexible delivery tube extending from said pump through the delivery spout, said flexible delivery tube being slidable into and out of the delivery spout.

13. A liquid soap reservoir module as recited in claim 11 wherein:

said pump is a positive displacement pump.

14. A liquid soap reservoir module as recited in claim 11 wherein:

said pump extends through a bottom wall means of said container section.

15. A liquid soap reservoir module as recited in claim 14 further comprising:

a pump suction nozzle affixed to said pump below said bottom wall means.

16. A viscous fluid reservoir module for use with a viscous fluid dispensing apparatus, the viscous fluid dispensing apparatus including a delivery spout, said viscous fluid reservoir module comprising:

a) a container section including an enclosing top section and a lower cap affixed thereto;

b) a pump housing affixed to said container section;

c) a guide cylinder extending from said enclosing top section into said container section and in alignment with said pump housing;

d) a flexible delivery tube extending from said pump housing through the delivery spout, said flexible delivery tube being slidable into and out of the delivery spout, said flexible delivery tube having a distal end extending beyond the delivery spout thereby preventing any viscous fluid being dispensed from contacting the viscous fluid dispensing apparatus.

17. A viscous fluid reservoir module as recited in claim 16 further comprising:

a pump drive shaft extending from said pump housing into said guide cylinder, said pump drive shaft abutting a free distal end of an actuator rod when said viscous fluid reservoir module is mounted to the viscous fluid dispensing apparatus, the actuator rod extending from the viscous fluid dispensing apparatus.

18. A viscous fluid reservoir module as recited in claim 16 further comprising:

a piston slidably contained within said pump housing, said piston having a plurality of hinged wing members extending therefrom, said hinged wing members sealingly engaging the walls of said pump housing when said piston is moved downward and disengaging from the walls of said pump housing when said piston is moved toward said top section.

19. A viscous fluid reservoir module as recited in claim 16 wherein:

said pump housing extends through a bottom wall means of said container section.

20. A viscous fluid dispensing apparatus for mounting on a supporting surface, said viscous fluid dispensing apparatus for use with a viscous fluid reservoir module including a pump, said viscous fluid dispensing apparatus comprising:

a) a frame including a nipple for extending through the supporting surface;

b) an actuator rod channel in said frame for receiving an actuator assembly, said actuator assembly extending through said frame and said nipple and having a distal end unaffixed to a pump piston, said distal end abutting and interactable with the pump when said distal end is inserted into the viscous fluid reservoir module.

21. A viscous fluid dispensing apparatus as recited in claim 20 wherein:

said actuator rod channel includes an upper section and a lower section, said upper section being obtusely angulated from said lower section.

22. A viscous fluid dispensing apparatus as recited in claim 20 wherein:

said actuator assembly is comprised of an upper actuator rod, a lower actuator rod and a link member pivotally connected to both said upper actuator rod and said lower actuator rod.

* * * * *